US005213263A

United States Patent [19]

Corona

[11] Patent Number: 5,213,263

[45] Date of Patent: May 25, 1993

[54] DEVICE FOR METERING AND MIXING A DETERGENT WITH WATER AND COMPRESSED AIR UNDER CONTROL OF AN ATOMIZING LANCE TRANSFORMING ALSO THE JET INTO FOAM

[76] Inventor: Monica Corona, Via Chavez 4, Milan 20131, Italy

[21] Appl. No.: 725,790

[22] Filed: Jul. 9, 1991

[30] Foreign Application Priority Data

Jul. 9, 1990 [IT] Italy ..... 35886/90[U]

[51] Int. Cl.[5] ..... B05B 7/04; B05B 7/26

[52] U.S. Cl. ..... 239/304; 239/311; 239/335; 239/416.1

[58] Field of Search ..... 239/304, 307, 308, 310, 239/311, 335, 373, 526, 416.1, 417.5, 428, 432

[56] References Cited

U.S. PATENT DOCUMENTS

| | | | |
|---|---|---|---|
| 2,640,724 | 6/1953 | Sanders et al. | 239/311 |
| 2,931,580 | 4/1960 | Johnson | 239/417.5 |
| 2,941,900 | 6/1960 | Schroder-Stranz | 239/307 |
| 3,094,171 | 6/1963 | Gagliardo | 239/526 |
| 3,103,312 | 9/1963 | Damrow | 239/416.1 |
| 3,653,549 | 4/1972 | Cannon | 239/311 |
| 3,779,463 | 12/1973 | Schlidt | 239/308 |
| 3,822,217 | 7/1974 | Rogers | 239/311 |
| 4,113,182 | 9/1978 | Brago | 239/416.1 |

*Primary Examiner*—Andres Kashnikow
*Assistant Examiner*—Karen B. Merritt
*Attorney, Agent, or Firm*—James P. Hanrath; Thomas R. Vigil

[57] ABSTRACT

A metering and mixing device is disclosed including a hand truck carrying a couple of tanks of varied capacity, one for water, the other for the cleansing agent, which are connected to an atomizing lance, and a plurality of valves, feed cocks and meters for controlling the flow of water, detergent and compressed air from said tanks through the atomizing lance. The latter is provided with a first chamber for mixing the detergent with water, and a second chamber for the foaming. Both the metering of the detergent and the foaming can be controlled through hand controls provided on the lance.

10 Claims, 2 Drawing Sheets

DEVICE FOR METERING AND MIXING A DETERGENT WITH WATER AND COMPRESSED AIR UNDER CONTROL OF AN ATOMIZING LANCE TRANSFORMING ALSO THE JET INTO FOAM

BACKGROUND OF THE INVENTION

1. Field of the Invention

The present invention relates generally to devices for metering and mixing a detergent or cleansing agent with water and compressed air.

2. Description of the Related Art Including Information Disclosed Under 37 CRF §1.97–1.99

It is known that in the cleansing field the liquid products are sold under concentrated form to be later diluted in the most suitable way depending on the dirt to be washed off.

To this end, reservoirs made of metals resistant to the pressure, where the cleansing agent is diluted, can be used in the industrial field. The mixture is then sprayed from the reservoir under pressure through an atomizing gun. Such a system needs frequent loading and unloading operations which could be requested in non-convenient times (reference could be made to a washing station where cars are queuing).

In addition, there is no chance of adjusting the concentration depending on the dirt to be washed off.

It is also known that the detergent supplied as a foam is more active and adapted to be applied to walls.

SUMMARY OF THE INVENTION

The device of the present invention causes the dilution of the detergent to vary and the solution to be transformed into foam, if requested, by a set of hand controls located on the atomizing gun or lance held by the operator.

According to one embodiment such a device includes a couple of tanks of varied capacity supported on a hand truck with two wheels, and a set of check valves and/or pneumatic valves and/or electrovalves adjusting the flow and the outlet of water, compressed air and concentrated detergent from said tanks through an atomizing gun provided with two small chambers in its handle, in one of which said component are mixed and in the second of which the foam is formed. Three pipes are passed through an outer enclosing tube connecting the lance to the hand truck and feed water and detergent from the two tanks to the first chamber, and compressed air from an air source to the second chamber.

This arrangement facilitates considerably the action of the operator who can adjust through hand controls located in the handle of the gun both the quantity of detergent mixed with water and the feeding of compressed air for the foaming without leaving the working area.

BRIEF DESCRIPTION OF THE DRAWINGS

The present invention will be more readily understood with reference to the description and the accompanying drawing showing a preferred embodiment of the invention. In the drawing.

DESCRIPTION OF THE PREFERRED EMBODIMENT

Figure 1:
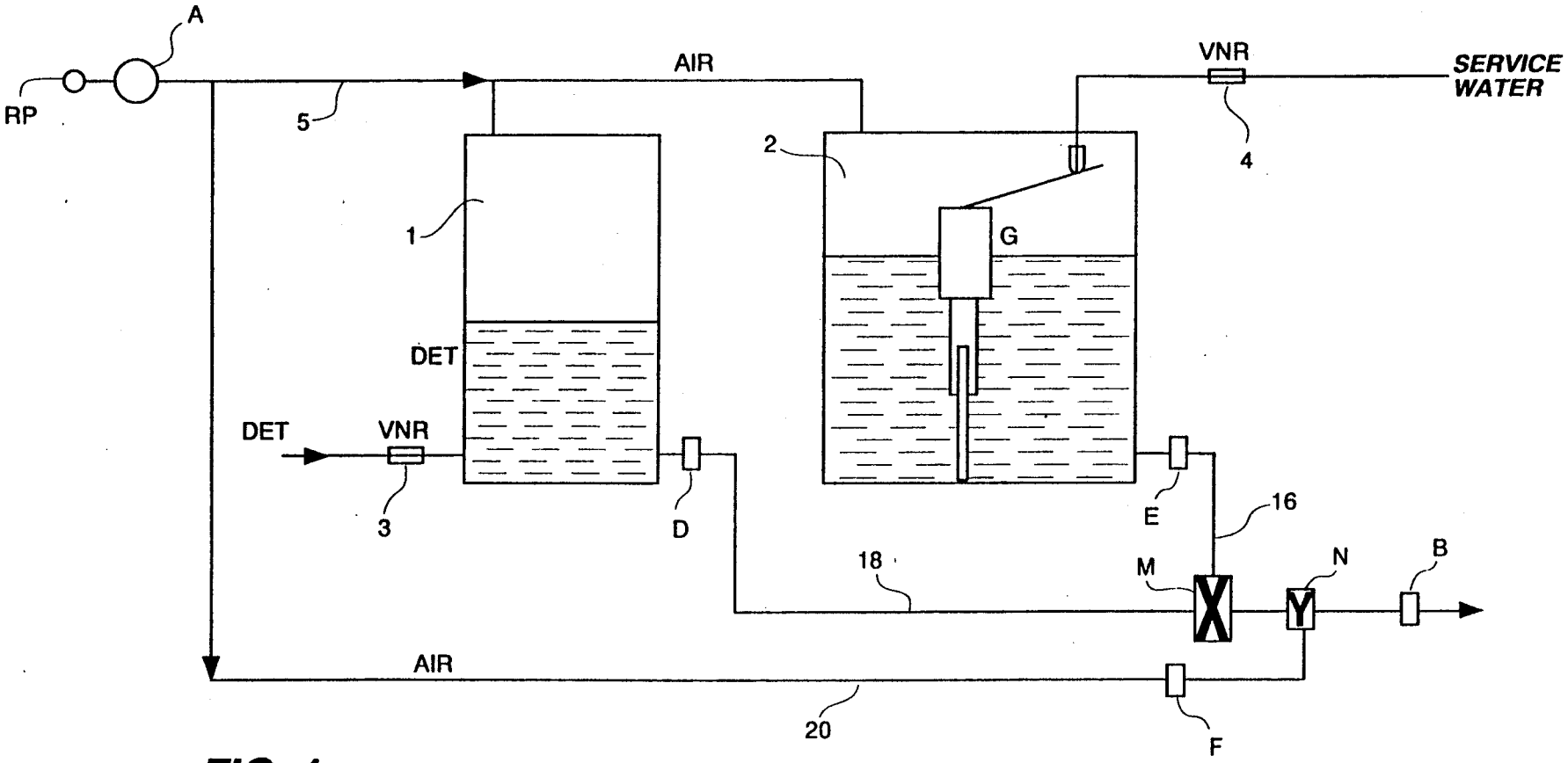
FIG. 1 is a schematic view of the device.

With reference to FIG. 1 two tanks containing the concentrated detergent and water are indicated at 1 and 2, respectively. The detergent is loaded into tank 1 through a check valve 3, and tank 2 is connected to the service water through another check valve 4. Such check valves 3 and 4 allow detergent and water to be supplied only through meters D and E which can be formed of a sized hole and an adjustable hole, respectively.

In the schematic diagram compressed air from any air source is fed at the desired pressure into tanks 1 and 2 through a pressure reducing valve RP and a three-way valve A.

The water and the concentrated detergent are mixed in chamber M filled of material promoting the mixing thereof, for example gauze or wire-gauze. The diluted solution of the detergent flows through valve B. The control lever of valve A is actuated to control the leakage of tanks 1 and 2 restoring the atmospheric pressure therein. Then fresh water up to the predetermined level is fed from the water system into tank 2, for example, through a ball cock G, and further detergent can be supplied from a detergent tank under the atmospheric pressure into tank 1 through a ball cock (not shown) or the like due to the principle of communicating vessels.

The device is then ready for the next mixing.

In case the foaming of the detergent is requested, meter F is activated. Air is admixed to the diluted detergent in chamber N filled with material y promoting the foaming.

Figure 2:
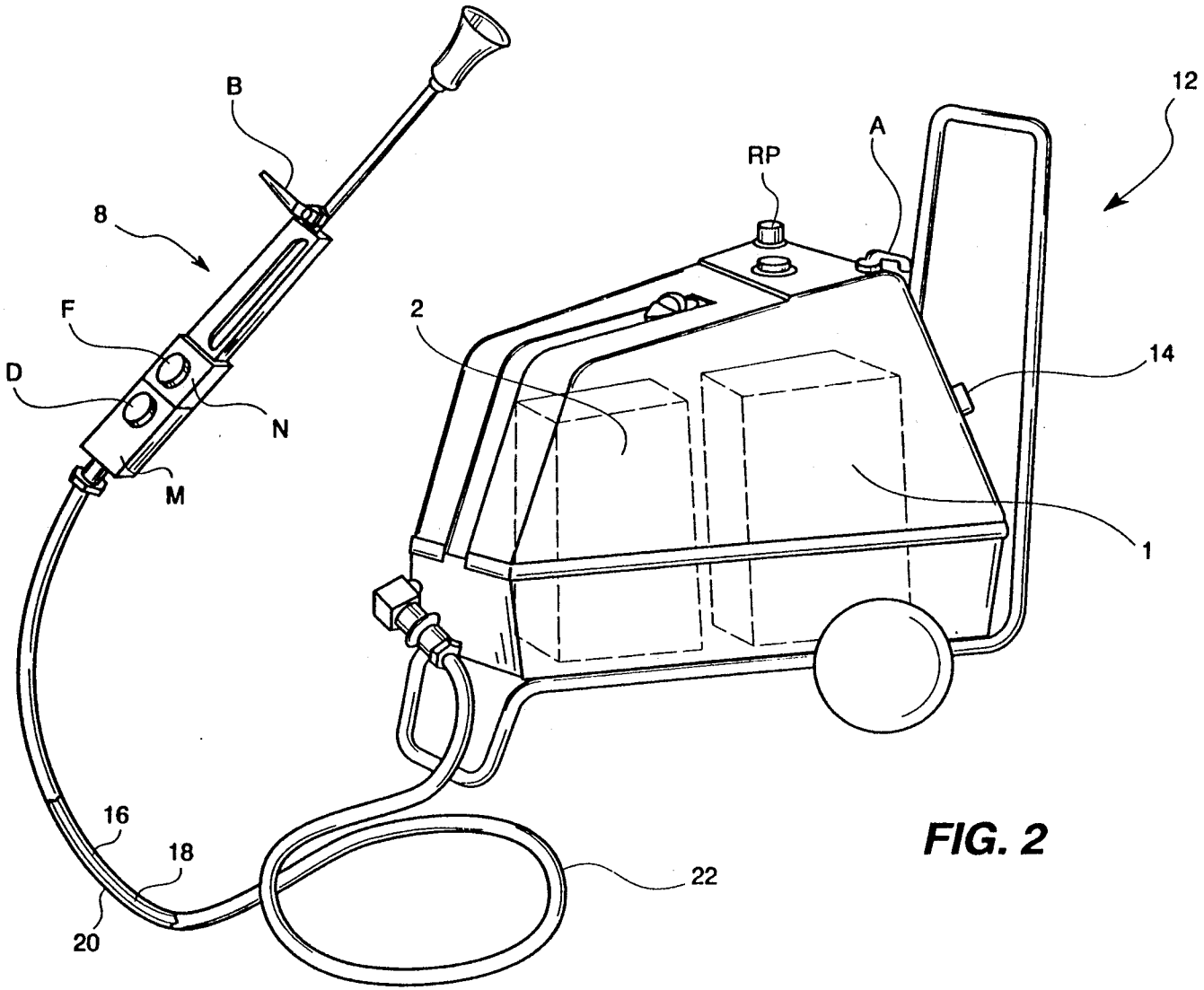
FIG. 2 shows the device with the hand truck carrying the tanks and the atomizing and foaming lance.

As one can see in FIG. 2, mixing chambers M and N and meters D and F are located directly on the spray lance 8 to the advantage of the operator, and the two tanks 1 and 2 are located within the hand truck 12 provided with two wheels and carrying a housing including the coupling 14 for the compressed air, the pressure reducing valve RP, the three-way valve A, and the check valves 3 and 4. Water and detergent are fed to chamber M through pipes 16 and 18, and the compressed air is fed to chamber N through a third pipe 20. The three pipes are contained in an outer enclosing pipe 22.

Of course the described spray lance can be replaced by any fixed or moving equipment for dispensing atomized fluid or foam.

I claim:

1. A device for metering and mixing a detergent or cleansing agent with water and compressed air, characterized in that it includes a pair of tanks (1,2), containing the detergent and the water, respectively, said tanks being contained in a housing supported on a moving hand truck (12) and connected to a compressed air pipe connected in turn to an outer air source through a coupling (14) provided on said housing, an atomizing gun or lance (8) having a handle connected with a flexible pipe to the housing, means provided on said housing for controlling the inlet of compressed air into said tanks, means provided on said handle of the atomizing gun or lance for controlling the outlet of water and detergent from said tanks due to the compressed air through two separated pipes (16, 18) housed into the flexible pipe and connected to a mixing chamber (M) located in the handle, and a foaming chamber (N) located in the handle downstream of the mixing chamber (M) having a foaming meter for controlling the flow of compressed air in through a third pipe (20) connected from the coupling of the outer air source to said foaming chamber in order to provide a foam directly adjustable by the operator.

2. The device of claim 1, wherein said water tank (2) is loaded with water from a water system through a check valve (4).

3. The device of claim 1, wherein the inlet of water into said water tank (2) is controlled by a ball cock (G).

4. The device of claim 1, wherein said detergent tank (1) is loaded through a check valve (3) from another source.

5. The device of claim 1, characterized in that it includes a pressure reducing valve (RP) and a three-way valve (A) through which compressed air at the desired pressure is blown into said water and detergent tanks (1 and 2) from the coupling (14) provided on the housing.

6. The device of claim 1, wherein a check valve (3) to the detergent tank and a check valve (4) to the water tank allows detergent and water to be fed from the respective tanks (1 and 2) only through a detergent meter (D) and a water meter (E), respectively.

7. The device of claim 1, wherein said mixing chamber (M) for mixing water and detergent is filled with material promoting the mixing.

8. The device of claim 1 wherein said foaming meter (F) is provided at the end of said third pipe (20) to said foaming chamber (N).

9. The device of claim 1, wherein said foaming chamber (N) is filled with material promoting foaming when compressed air is admixed with detergent in the foaming chamber.

10. The device of claim 1, wherein said foaming meter (F) for controlling the flow of the compressed air into said foaming chamber (N), and a valve (D) for controlling the flow of detergent into said mixing chamber (M) are located on the handle of the atomizing gun or lance.

* * * * *

UNITED STATES PATENT AND TRADEMARK OFFICE

CERTIFICATE OF CORRECTION

PATENT NO. : 5,213,263

DATED : May 25, 1993

INVENTOR(S) : Monica Corona

It is certified that error appears in the above-indentified patent and that said Letters Patent is hereby corrected as shown below:

Column 2, Line 60 after "said tanks," insert --and means for controlling the inlet of water and detergent into said tanks,--

Signed and Sealed this

Twenty-eighth Day of June, 1994

*Attest:*

Bruce Lehman

BRUCE LEHMAN

*Attesting Officer*

*Commissioner of Patents and Trademarks*